US007181026B2

(12) United States Patent
Zhang et al.

(10) Patent No.: US 7,181,026 B2
(45) Date of Patent: Feb. 20, 2007

(54) POST-PROCESSING SCHEME FOR ADAPTIVE DIRECTIONAL MICROPHONE SYSTEM WITH NOISE/INTERFERENCE SUPPRESSION

(76) Inventors: Ming Zhang, Blk 824 Jurong West St 81, #08-454, Singapore (SG) 640824; Zhuliang Yu, #03-403, Li Fu Street, No. 8, Nanjing (CN); Hui Lan, 1178 McCarthy Blvd., Milpittas, CA (US) 95035

( * ) Notice: Subject to any disclaimer, the term of this patent is extended or adjusted under 35 U.S.C. 154(b) by 368 days.

(21) Appl. No.: 10/486,784

(22) PCT Filed: Aug. 13, 2001

(86) PCT No.: PCT/SG01/00163

§ 371 (c)(1),
(2), (4) Date: Aug. 13, 2004

(87) PCT Pub. No.: WO03/017718

PCT Pub. Date: Feb. 27, 2003

(65) Prior Publication Data

US 2004/0258255 A1 Dec. 23, 2004

(51) Int. Cl.
*H04R 3/00* (2006.01)

(52) U.S. Cl. ..... 381/92

(58) Field of Classification Search ..... 381/92, 381/91, 122, 94.7, 369, 71.11–71.12, 94.1–94.3
See application file for complete search history.

(56) References Cited

U.S. PATENT DOCUMENTS 4,653,102 A 3/1987 Hansen
4,742,548 A 5/1988 Sessler et al.
5,121,426 A 6/1992 Baumhauer, Jr. et al.
5,226,076 A 7/1993 Baumhauer, Jr. et al.
5,471,538 A * 11/1995 Sasaki et al. ..... 381/92
5,703,903 A * 12/1997 Blanchard et al. ..... 375/232
5,703,957 A 12/1997 McAteer
5,740,256 A * 4/1998 Castello Da Costa et al. ..... 361/94.7
5,796,819 A * 8/1998 Romesburg ..... 379/406

FOREIGN PATENT DOCUMENTS

EP 0569216 A 11/1993

OTHER PUBLICATIONS

R. Martin and J. Altenhoner "Couples adaptive filters for acoustic echo control and noise reduction," ICASSP '95, pp. 3043-3046, 1995.*

(Continued)

*Primary Examiner*—Vivian Chin
*Assistant Examiner*—Lun-See Lao
(74) *Attorney, Agent, or Firm*—Davidson Berquist Jackson & Gowdey LLP

(57) ABSTRACT

The present invention provides an adaptive directional microphone system for enhancing an acoustic signal from a second direction and for reducing an acoustic signal from at least a first direction different from the second direction, the system comprising:

an omni-directional microphone and a directional microphone being arranged in a closely acoustically-coupled way;

an adaptive filtering circuit system for generating a first error signal e1(n) corresponding to an acoustic signal in which the acoustic signal from the first direction is reduced; and a post-processing filter system for producing a second error signal e2(n) corresponding to an acoustic signal in which the acoustic signal from the second direction is enhanced as compared to the acoustic signal related to the first error signal e1(n).

23 Claims, 2 Drawing Sheets

OTHER PUBLICATIONS

B. Widrow et al., "Adaptive Noise Canceling: Principles and Applications," Proceedings of IEEE, vol. 63, No. 12, Dec. 1975.

R. Martin and J. Altenhoner, "Couples adaptive filters for acoustic echo control and noise reduction," ICASSP '95, pp. 3043-3046, 1995.

* cited by examiner

POST-PROCESSING SCHEME FOR ADAPTIVE DIRECTIONAL MICROPHONE SYSTEM WITH NOISE/INTERFERENCE SUPPRESSION

BACKGROUND AND PRIOR ART

This application is the National Phase of International Application PCT/SG01/00163 filed 13 Aug. 2001 which designated the U.S. and that International Application was published under PCT Article 21(2) in English.

1. Field of the Invention

This invention relates to an adaptive directional microphone system with high spatial selectivity and noise/interference suppression and, more particularly, to an adaptive directional microphone system capable of suppressing background noise and the undesired signals from the first directions and remaining the desired signal from the second directions, and to a hand-free high spatial selectivity microphone, such as for use with a computer voice input system, a hand-free communication voice input system, or the like.

2. Description of the Related Art

A normal directional microphone system is a microphone system having a directivity pattern. The directivity pattern describes the directional microphone system's sensitivity to sound pressure from different directions. It can provide higher gain at some wider areas in direction normally around the front direction (0°-axis) (in the present invention, referred to as the first directions) and lower gain or even null at some other directions normally around the back direction (referred to as the second directions in the present invention). The purpose of the directional microphone system is to receive sound pressure originating from a desirable sound source, such as speech, and attenuate sound pressure originating from undesirable sound sources, such as noise. The directional microphone system is typically used in noisy environments, such as a vehicle or a public place.

Directional microphones receiving a maximum amount of desired sound from a desired direction and meanwhile rejecting undesired noise at a second or null directions, are generally well known in the prior art. Examples include cardioid-type directional microphones, such as cardioid, hyper-cardioid and super-cardioid directional microphones. However, those microphones are of very broad main beam and very narrow null. In many applications such as computer voice input system or the like, a directional microphone system, which has a narrow main beam with much higher gain than that in the other directions, is required to acquire only the desired sound from one direction and suppress the undesired noise from the any other directions.

One known technique for achieving directionality is through the use of a first-order-gradient (FOG) microphone element which comprises a movable diaphragm with front and back surfaces enclosed within a capsule. The prior arts of directional microphones, such as in U.S. patents U.S. Pat. No. 4,742,548, U.S. Pat. No. 5,121,426, U.S. Pat. No. 5,226,076 and U.S. Pat. No. 5,703,957, etc., only can provide a null with very low gain at certain narrow directions but a beam with high gain at broad directions. In applications for such a microphone, the null of the microphone must be towards the undesired noise source and meanwhile the desired sound source should be positioned at the first directions of the microphone. However, in practice, the arrangement is somewhat cumbersome because sometimes it is difficult to arrange the undesired noise source and desired sound source as above and moreover the noise may not come from a fixed direction. For example, there may be multiple noise sources from different directions or distributed noise source.

A directional microphone system has been previously suggested in the PCT patent application No. PCT/SG00/00080 (not yet published) that uses an omni-directional microphone and a directional microphone with an adaptive filtering circuit to suppress undesired signals from the first directions and retain the desired signal from second directions.

The present invention is to enhance the performance of noise/interference suppression and narrow the range of the main beam for the above invention by a new post-processing scheme.

SUMMARY OF THE INVENTION

It is an object of the invention to provide an adaptive directional microphone system for enhancing an acoustic signal from a second direction and for reducing an acoustic signal from at least a first direction different from the second direction.

This object is achieved by an adaptive directional microphone system according to the independent claim. Advantageous embodiments of the invention are described in the dependent claims.

The present invention provides an adaptive directional microphone system for enhancing an acoustic signal from a second direction and for reducing an acoustic signal from at least a first direction different from the second direction. The system comprises the following components.

An omni-directional microphone having a first directivity pattern, therein providing a similar gain for acoustic signals at least from the first direction and from the second direction; and a directional microphone having a second directivity pattern, therein providing a higher gain for acoustic signals from the first directions than for acoustic signals from the second direction. The omni-directional microphone and the directional microphone are arranged in a closely acoustically-coupled way. The omni-directional microphone is designed to output a first digital signal m1(n) upon receiving an acoustic signal. The directional microphone is designed to output a second digital signal m2(n) upon receiving an acoustic signal.

An adaptive filtering circuit system for generating, based on the first digital signal m1(n) and on the second digital signal m2(n), a filter output signal y1(n) corresponding to an acoustic signal from the first direction and for canceling out said filter output signal y1(n) from the first digital signal m1(n), so as to generate a first error signal e1(n) corresponding to an acoustic signal in which the acoustic signal from the first direction is reduced.

A post-processing filter system for producing, based on the first error signal e1(n), the filter output signal y1(n), and the first digital signal m1(n), a second error signal e2(n) corresponding to an acoustic signal in which the acoustic signal from the second direction is enhanced as compared to the acoustic signal related to the first error signal e1(n).

The present invention has the advantage that it provides an adaptive post-processing filter to enhance noise/interference suppression of the adaptive directional microphone system that is of a narrow main beam with much higher gain than other directions, that is, to provide an adaptive directional microphone system to be able to achieve a good directivity pattern and high noise/interference suppression.

Preferentially, the omni-directional microphone has such a first directivity pattern, which provides a similar gain for acoustic signals from all directions.

The directional microphone preferentially provides a very low gain for acoustic signals from the second directions, and more preferentially, the directional microphone provides zero gain for the second directions. The directional microphone can provide a very low gain also for signals from directions very close to the second directions. The closer the directions of low gain of the directional microphone are to the second directions, the narrower the main beam of the entire adaptive directional microphone system will be.

Preferentially, in the adaptive directional microphone system, at least one of the adaptive filtering circuit system and the post-processing filter system comprises a spectral transformation circuit (e.g. an FFT circuit) for transforming a time domain signal into a frequency domain signal. In this case, at least part of the filtering performed in the system is performed in the frequency domain.

The spectral transformation circuit can be e.g. a Fourier transformation circuit, an FFT circuit, a DFT circuit (DFT=discrete Fourier transformation), a DCT circuit (DCT=discrete cosine transformation), a DST circuit (DST=discrete sine transformation) or a Laplace transformation circuit.

In the adaptive filtering circuit system, the time domain first digital signal m1(n) and the time domain second digital signal m2(n) can be used directly to generate a time domain filter output signal y1(n) and a time domain first error signal e1(n).

Alternatively, in the adaptive filtering circuit system, the time domain first digital signal m1(n) and the time domain second digital signal m2(n) can first be spectrally transformed to a respective frequency domain first digital signal M1(k) and frequency domain second digital signal M2(k). In this case, a frequency domain filter output signal Y1(k) and a frequency domain first error signal E1(k) are generated from M1(k) and M2(k). M1(k), Y1(k) and E1(k) can be sent to the post-processing filter system and can there be directly further processed. Alternatively, if the post-processing filter system is designed to receive time domain signals, the adaptive filtering circuit system can comprise circuits for inversely spectrally transforming frequency domain signals into time domain signals before sending them to the post-processing filter system.

Still alternatively, a time domain first digital signal m1(n), a time domain filter output signal y1(n) and a time domain first error signal e1(n) from the adaptive filtering circuit system can be spectrally transformed in the post-processing filter system, so as to generate a frequency domain first digital signal M1(k), a frequency domain filter output signal Y1(k) and a frequency domain first error signal E1(k). M1(k), Y1(k) and E1(k) are then further processed in the post-processing filter system.

The post-processing filtering system can be operating in the time domain, and its output can be a time domain second error signal e2(n). Alternatively, the post-processing filtering system can be operating in the frequency domain, and its output can first be a frequency domain second error signal E2(k) which is then inversely spectrally transformed into a time domain second error signal e2(n). An inverse spectral transformation circuit (e.g. an IFFT circuit) of the post-processing filtering system or an external inverse spectral transformation circuit can be used for this purpose.

The adaptive directional microphone system according to the invention can operate as a noise canceling microphone system. It can be used to cancel noise coming from an environment (e.g. from some first directions) out from a desired signal coming from a specific second direction. The adaptive directional microphone system according to a typical embodiment comprises an omni-directional microphone and a normal (e.g. cardioid-type) directional microphone, preamplifiers, A/D converters, a D/A converter, an adaptive filtering circuit, a post-processing filter circuit, and additionally, a specially designed case.

Adaptive filters are used to remain the desired signals from the second directions of the directional microphone and cancel the undesired signals from the first directions. A post-processing filter is used to enhance further the desired signals from the main beam and other undesired signals from the other directions.

Other objects, features and advantages according to the present invention will be presented in the following detailed description of the illustrated embodiments when read in conjunction with the accompanying drawings.

DETAILED DESCRIPTION OF PREFERRED EMBODIMENTS OF THE INVENTION

Figure 1:
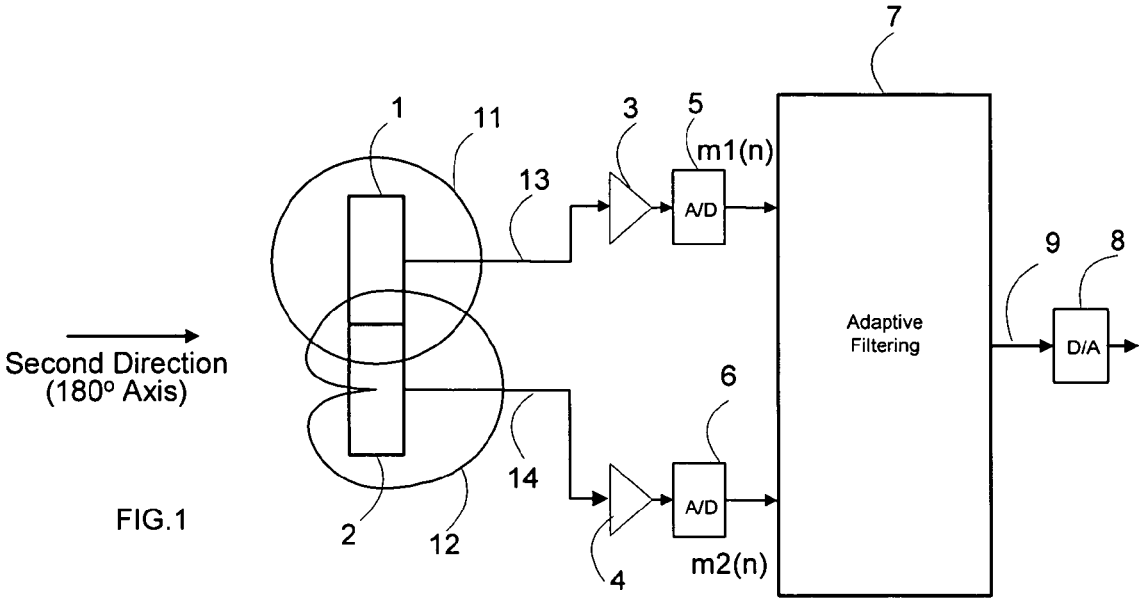
FIG. 1 illustrates a structure diagram of an embodiment of the prior art using a cardioid directional microphone.

FIG. 1 illustrates the structure diagram of an embodiment of the microphone system underlying the present invention. Omni-directional microphone 1 with a directivity pattern 11 is adhered to directional microphone 2 with a directivity pattern 12. There are two (pairs of) wires 13 and 14 to capture the signals from the two microphones 1 and 2, respectively. The sounds received by said omni-directional microphone 1 are amplified by first preamplifier 3 and then converted to first digital signal m1(n) by first A/D converter 5. The sounds received by cardioid directional microphone 2 are amplified by second preamplifier 4 and then converted to second digital signal m2(n) by second A/D converter 6. Both of digital signals m1(n) and m2(n) are sent to adaptive filtering circuit 7 which can be implemented by least-mean-square (LMS) algorithm described in reference [1]. The result signal after processing is outputted at output 9 through D/A converter 8. If a sound comes from the null direction (180°), said omni-directional microphone 1 can receive it with a quite high gain, but said cardioid directional microphone 2 can not receive it or only can receive it with a very low gain. On the other hand, if the same sound comes from any other directions, both said microphones 1 and 2 can receive it with similar gains and moreover the received signals from both microphones 1, 2 are highly correlated. So when a desired sound comes from the null direction and meanwhile undesired sounds come from the other directions, the undesired sounds can be canceled and the desired sound can be remained by said adaptive filtering circuit 7 in the noise canceling microphone system.

Figure 2:
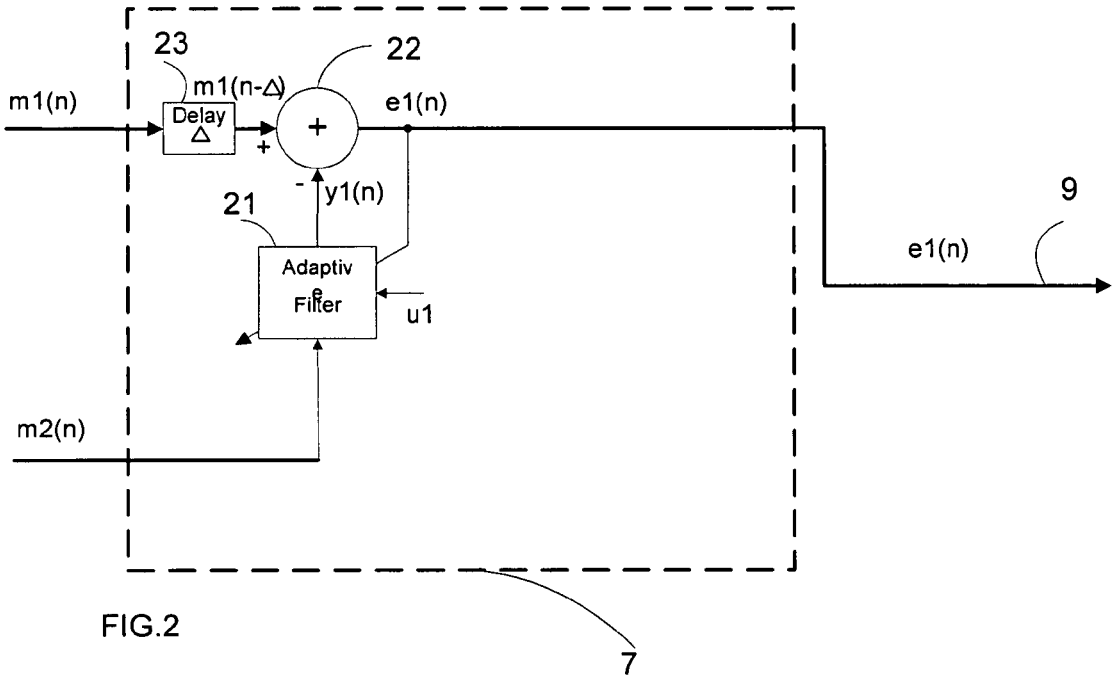
FIG. 2 illustrates a schematic diagram of an adaptive filtering circuit according to an embodiment disclosed in the PCT patent application No. PCT/SG00/00080.

FIG. 2 illustrates a scheme for the operation of said adaptive filtering circuit 7 of FIG. 1, associated with said omni-directional microphone 1 and said directional microphone 2 as a first embodiment of said adaptive filtering circuit 7. Said first digital signal m1(n) is delayed a predetermined number of Δ (Δ≧0) samples by a delay circuit 23 to generate a delayed signal m1(n−Δ). Said adaptive filter 21 is used to estimate the component in said delayed signal m1(n−Δ) due to the sounds coming from the first directions and outputs said filter output signal y1(n). Said delayed signal m1(n−Δ) is subtracted by said filter output signal y1(n) at said adder 22 to get said error signal e1(n). Said adaptive filter 21 receives said second digital signal m2(n) as reference signal and said error signal e1(n) to update its coefficient based on said step size u1. Said error signal e1(n) is outputted as a result of this operation.

Figure 3:
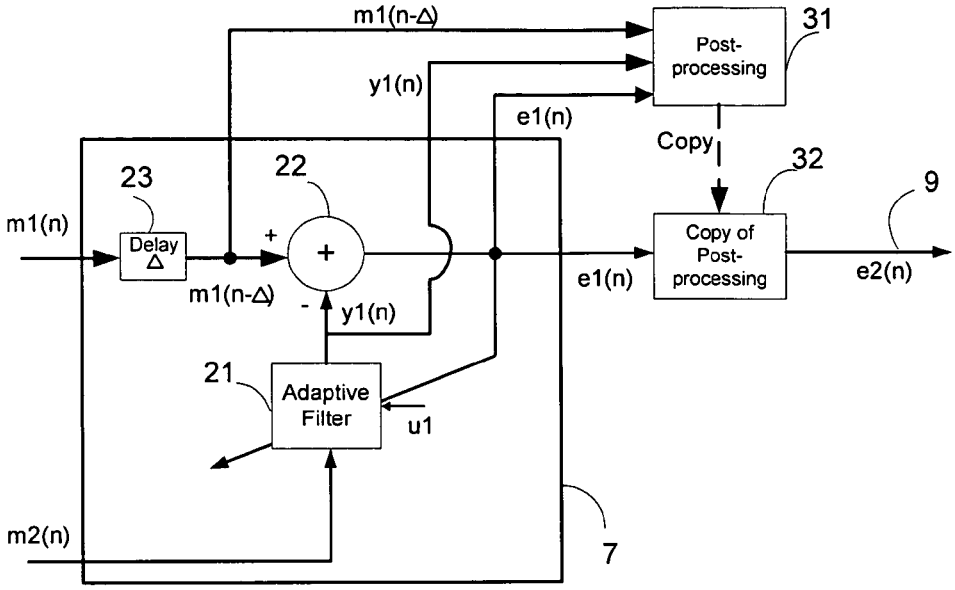
FIG. 3 illustrates a schematic diagram of an adaptive filtering circuit with post processing according to an embodiment of the present invention.

FIG. 3 illustrates a scheme for the operation of adaptive filtering 7 with post-processing 31 and 32 in the present invention, associated with said omni-directional microphone 1 and said directional microphone 2 as a first embodiment of said adaptive filtering circuit 71. Said first digital signal m1(n) is delayed a predetermined number of Δ (Δ≧0) samples by a delay circuit 23 to generate a delayed signal m1(n−Δ). Said adaptive filter 21 is used to estimate the component in said delayed signal m1(n−Δ) due to the sounds coming from the first directions and outputs said filter output signal y1(n). Said delayed signal m1(n−Δ) is subtracted by said filter output signal y1(n) at said adder 22 to get said error signal e1(n). Said adaptive filter 21 receives said second digital signal m2(n) as reference signal and said error signal e1(n) to update its coefficient based on said step size u1. Said error signal e1(n) is then inputted into a post-processing circuit 32 to produce a new signal e2(n). Said signal e2(n) is outputted as a result of this operation. Coefficients of said post-processing 32 is copied from a post-processing 31 which is formed by said delayed signal m1(n−Δ), said filtered output signal y1(n), and said error signal e1(n). Said post-processing 32 can enhance the desired signal from said second direction and suppress the unwanted signals from other directions further. So said post-processing circuit 32 can improve the performance of directivity much.

Figure 4:
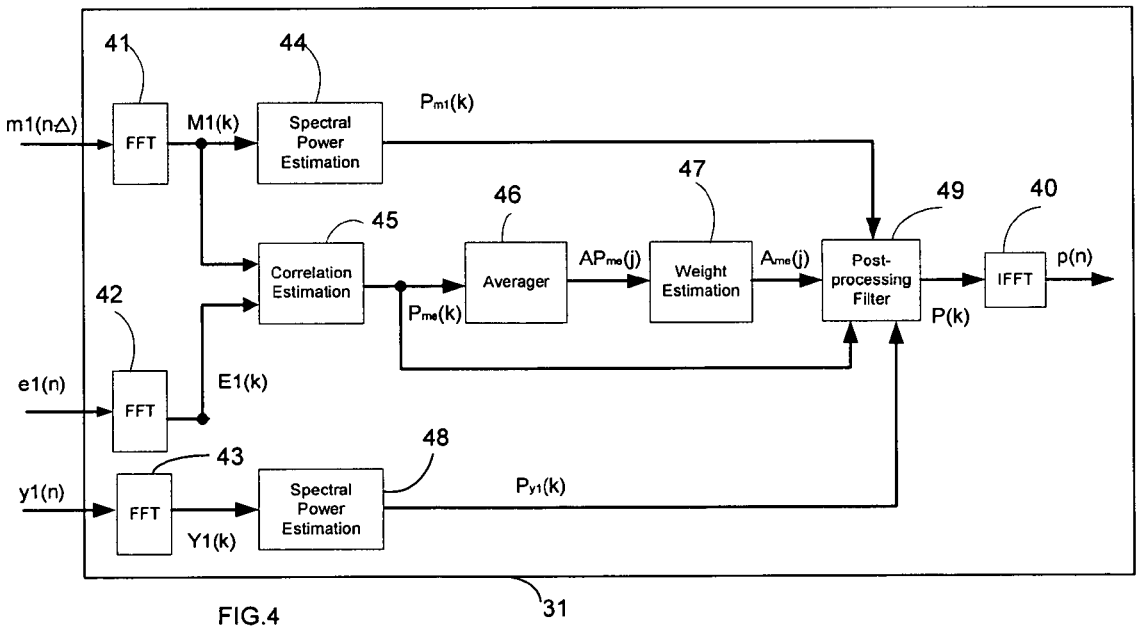
FIG. 4 illustrates a schematic diagram of a post-processing circuit according to an embodiment of the present invention.

FIG. 4 illustrates a scheme for the operation of said post-processing circuit 31 in the present invention, associated with said omni-directional microphone 1 and said directional microphone 2 as a first embodiment of said adaptive filtering circuit 7. Said first delayed signal m1(n−Δ) is inputted into FFT circuit 41 to do Fourier transformation to get a counterpart signal M1(k) in frequency domain. Said first error signal e1(n) is inputted into FFT circuit 42 to generate a counterpart signal E1(k) in frequency domain by Fourier transformation. Said filter output signal y1(n) is inputted into FFT circuit 43 to generate a counterpart signal Y1(k) in frequency domain by Fourier transformation. After that, said signal M1(k) is used to compute its power signal Pm1(k) by spectral power estimation circuit 44, and said signal Y1(k) is used to compute its power signal Py1(k) by spectral power estimation circuit 48. The formulas for computing Pm1(k) and Py1(k), respectively, are as follows:

$$Pm1(k)=\alpha Pm1(k-1)+(1-\alpha)M1(k)\cdot M1^*(k),$$

and $$Py1(k)=\alpha Py1(k-1)+(1-\alpha)Y1(k)\cdot Y1^*(k)$$

where α is the forgetting factor for the power computation and * denotes conjugate computation for a complex. Said signals M1(k) and E1(k) are also used to calculate a correlation signal Pme(k) by a correlation estimation circuit 45, and then Pme(k) is averaged in block j to get an average correlation signal APme(j) by an averager circuit 46. The detailed estimation is as follows:

$$Pme(k)=\alpha Pme(k-1)+(1-\alpha)M1(k)\cdot E1^*(k)$$

and $$APme(j)=\Sigma Pme(k)/L \text{ for all } k \text{ in the block}$$

where the signal is transformed by FFT circuit on basis of blocks, L is the length of each block, Σ denotes the sum computation, and j is the index of the block. Said average correlation signal APme(j) is then inputted into a weight estimation circuit 47 to generate a weight signal Ame(j). The detailed computation is described as follows:

$$Ame(j)=a/(APme(j)+b)^c$$

where a, b and c are the positive constants which can be predefined. Said weight signal Ame(j) is very important for the improvement of post-processing performance. Said power signal Pm1(k), said power signal Py1(k) and said correlation signal Pme(k) are used as the inputs of a post-processing filter 49 with said weight signal Ame(j) to form said post-processing 31. The detailed operations is as follows:

$$P(k)=Pme(k)/(Pm1(k)+Ame(j)\cdot Py1(k))$$

and $$p(n)=IFFT(P(k))$$

where P(k) is the coefficients of said post-processing filter 49 in frequency domain, IFFT denotes the inverse Fourier Transformation and p(n) is the coefficients of said post-processing filter 49 in time domain. p(n) is copied from said post-processing 31 to said post-processing circuit 32 in FIG. 3.

Above said adaptive filter 7 in FIG. 3 can be implemented using the fast block least-mean-square (FBLMS) algorithm in [2]. Thus said adaptive filter 7 is done in frequency domain. In such case, said coefficients P(k) of said post-processing filter 49 do not need to be transformed into time domain coefficients by IFFT. That means said coefficients P(k) can be used as the coefficients in said post-processing 31 and is also copied into said copy of post-processing 32.

Said post-processing 31 and 32 can also be extended to other applications, such as acoustic echo cancelation and speech enhancement etc.

OTHER REFERENCES

[1] B. Widrow et al., "Adaptive Noise Canceling: Principles and Applications", Proceedings of IEEE, vol. 63, No. 12, December 1975.

[2] B. Farhang-Boroujeny, Adaptive Filter—Theory and Applications, Chapter 8, John, Wiley & Sons, 1998.

[3] R. Martin and J. Altenhoner, "Coupled adaptive filters for acoustic echo control and noise reduction", ICASSP'95, pp. 3043–3046, 1995.

What is claimed is:

1. An adaptive directional microphone system for enhancing an acoustic signal from a second direction and for reducing an acoustic signal from at least a first direction different from the second direction, the system comprising:

an omni-directional microphone (1) having a first directivity pattern, therein providing a similar gain for acoustic signals at least from the first direction and from the second direction; and a directional microphone (2) having a second directivity pattern, therein providing a higher gain for acoustic signals from the first direction than for acoustic signals from the second direction; the omni-directional microphone (1) and the directional microphone (2) being arranged in a closely acoustically-coupled way; the omni-directional microphone (1) being designed to output a first digital signal (m1(n)) upon receiving an acoustic signal; and the directional microphone (2) being designed to output a second digital signal (m2(n)) upon receiving an acoustic signal;

an adaptive filtering circuit system (7) for generating, based on the first digital signal (m1(n)) and on the second digital signal (m2(n)), a filter output signal (y1(n)) corresponding to an acoustic signal from the first direction and for canceling out said filter output signal (y1(n)) from the first digital signal (m1(n)), so as to generate a first error signal (e1(n)) corresponding to an acoustic signal in which the acoustic signal from the first direction is reduced; and a post-processing filter system (31, 32) for producing, based on the first error signal (e1(n)), the filter output signal (y1(n)), and the first digital signal (m1(n)), a second error signal (e2(n)) corresponding to an acoustic signal in which the acoustic signal from the second direction is enhanced as compared to the acoustic signal related to the first error signal (e1(n)).

2. The adaptive directional microphone system according to claim 1, wherein at least one of the adaptive filtering circuit system (7) and the post-processing filter system (31, 32) comprises a spectral transformation circuit for transforming a time domain signal into a frequency domain signal.

3. The adaptive directional microphone system according to claim 1, wherein the adaptive filtering circuit system (7) comprises an adaptive filtering circuit (21) for receiving the second digital signal (m2(n)) and for generating the filter output signal (y1(n)) and an adder circuit (22) for canceling out from the first digital signal (m1(n)) the filter output signal (y1(n)).

4. The adaptive directional microphone system according to claim 3, wherein the adaptive filtering circuit system (7) further comprises a delay circuit (23) for delaying the first digital signal (m1(n)) so as to generate a delayed first digital signal (m1(n−Δ)) for inputting into the adder circuit (22).

5. The adaptive directional microphone system according to claim 3, wherein the adaptive filtering circuit (21) is designed to receive the first error signal (e1(n)) to update at least one coefficient of the adaptive filtering circuit (21) based on a predetermined step size (u1).

6. The adaptive directional microphone system according to claim 1, wherein the post-processing filter system (31, 32) comprises a first post-processing filter circuit system (31) for receiving and processing the first error signal (e1(n)), the filter output signal (y1(n)), and the first digital signal (m1(n)) and for outputting at least one coefficient (p(n)) of the first post-processing filter circuit system (31), and a second post-processing filter circuit system (32) for receiving and processing the first error signal (e1(n)) and the at least one coefficient (p(n)) output by the first post-processing filter circuit system (31) and for producing the second error signal (e2(n)).

7. The adaptive directional microphone system according to claim 6, wherein the first post-processing filter circuit system (31) comprises a post-processing filter circuit (49) for generating the at least one time domain coefficient (p(n)).

8. The adaptive directional microphone system according to claim 2, wherein the first post-processing filter circuit system (31) is designed to operate in the frequency domain, therein to receive and process a frequency domain first error signal (E1(k)), a frequency domain filter output signal (Y1(k)), and a frequency domain first digital signal (M1(k)) and to output at least one frequency domain coefficient (P(k)) of the first post-processing filter circuit system (31).

9. The adaptive directional microphone system according to claim 2, wherein the second post-processing filter circuit system (32) is designed to operate in the frequency domain, therein to receive and process a frequency domain first error signal (E1(k)) and the at least one frequency domain coefficient (P(k)) output by the first post-processing filter circuit (31) and to produce a frequency domain second error signal (E2(k)).

10. The adaptive directional microphone system according to claim 8, wherein the first post-processing filter circuit (31) comprises a spectral transformation circuit (41) for transforming the time domain first digital signal m1(n) to produce the frequency domain first digital signal (M1(k)), a spectral transformation circuit (42) for transforming the time domain first error signal e1(n) to produce the frequency domain first error signal (E1(k)), and a spectral transformation circuit (43) for transforming the time domain filter output signal y1(n) to produce the frequency domain filter output signal (Y1(k)).

11. The adaptive directional microphone system according to claim 10, wherein the first post-processing filter circuit system (31) comprises a post-processing filter circuit (49) for generating the at least one frequency domain coefficient (P(k)).

12. The adaptive directional microphone system according to claim 10, wherein the post-processing filter circuit (31) further comprises a spectral power estimation circuit (44) for computing a power first digital signal (Pm1(k)) from the frequency domain first digital signal (M1(k)), and a spectral power estimation circuit (48) for computing a power filter output signal (Py1(k)) from the frequency domain filter output signal (Y1(k)).

13. The adaptive directional microphone system according to claim 12, wherein the post-processing filter circuit (31) further comprises a correlation estimation circuit (45) for calculating a correlation signal (Pme(k)) from the frequency domain first digital signal (M1(k)) and the frequency domain first error signal (E1(k)).

14. The adaptive directional microphone system according to claim 13, wherein the post-processing filter circuit (31) further comprises an averager circuit (46) for averaging the correlation signal (Pme(k)) over at least one predetermined frequency range (j) so as to compute at least one average correlation signal (APme(j)).

15. The adaptive directional microphone system according to claim 14, wherein the post-processing filter circuit (31) further comprises a weight estimation circuit (47) for computing a weight signal (Ame(j)) from the average correlation signal (APme(j)).

16. The adaptive directional microphone system according to claim 15, wherein the post processing filter (49) is designed to compute the at least one frequency domain coefficient (P(k)) from the power first digital signal (Pm1(k)), the power filter output signal (Py1(k)), the correlation signal (Pme(k)) and the weight signal (Ame(j)).

17. The adaptive directional microphone system according to claim 16, further comprising an IFFT circuit (40) for inverse Fourier transforming the frequency domain coefficient (P(k)) to compute a time domain coefficient (p(n)) of the post-processing filter circuit system (31) for outputting to the second post-processing filter circuit (32).

18. The adaptive directional microphone system according to claim 2, wherein the adaptive filtering circuit system (7) is designed to operate in the frequency domain and comprises at least one spectral transformation circuit for transforming the time domain first digital signal (m1(n)) to compute a frequency domain first digital signal (M1(k)) and for transforming the time domain second digital signal (m2(n)) to compute a frequency domain second digital signal (M2(k)), and is designed to output a frequency domain first digital signal (M1(k)), a frequency domain filter output signal (Y1(k)) and a frequency domain first error signal (E1(k)), each frequency domain signal being the spectral transform of the corresponding time domain signal.

19. The adaptive directional microphone system according to claim 10, wherein at least one spectral transformation circuit is a Fourier transformation filter, an FFT filter, a DFT circuit, a DCT circuit, a DST circuit or a Laplace transformation circuit.

20. The adaptive directional microphone system according to claim 18, wherein the adaptive filtering circuit system (7) comprises an adaptive filtering circuit (21) for receiving the frequency domain second digital signal (M2(k)) and for generating the frequency domain filter output signal (Y1(k)) and an adder circuit (22) for canceling out from the frequency domain first digital signal (M1(k)) the frequency domain filter output signal (Y1(k)), so as to generate a frequency domain first error signal (E1(k)).

21. The adaptive directional microphone system according to claim 20, wherein the adaptive filtering circuit (21) is designed to receive the frequency domain first error signal (E1(k)) to update a coefficient of the adaptive filtering circuit (21) based on a predetermined step size (u1).

22. The adaptive directional microphone system according to claim 19, wherein the adaptive filter circuit (7) is implemented using the fast block least-mean-square (FBLMS) algorithm.

23. The adaptive directional microphone system according to claim 8, further comprising an IFFT circuit for inverse Fourier transforming the frequency domain second error signal (E2(k)) so as to compute the second error signal (e2(n)).

* * * * *